US009000936B2

(12) United States Patent
Hsieh

(10) Patent No.: US 9,000,936 B2
(45) Date of Patent: Apr. 7, 2015

(54) TORQUE WARNING HAND TOOL

(75) Inventor: Chih-Ching Hsieh, Taichung (TW)

(73) Assignee: Kabo Tool Company, Taichung (TW)

( * ) Notice: Subject to any disclaimer, the term of this patent is extended or adjusted under 35 U.S.C. 154(b) by 233 days.

(21) Appl. No.: 13/532,467

(22) Filed: Jun. 25, 2012

(65) Prior Publication Data

US 2013/0249700 A1 Sep. 26, 2013

(30) Foreign Application Priority Data

Mar. 21, 2012 (TW) ..... 101109722 A

(51) Int. Cl.
*G08B 21/00* (2006.01)
*B25B 23/142* (2006.01)

(52) U.S. Cl.
CPC ..... *B25B 23/1425* (2013.01)

(58) Field of Classification Search
None
See application file for complete search history.

(56) References Cited

U.S. PATENT DOCUMENTS

| | | | | |
|---|---|---|---|---|
| 6,607,041 | B2 * | 8/2003 | Suzuki et al. | 173/4 |
| 2007/0119269 | A1 * | 5/2007 | Anjanappa et al. | 73/862.21 |
| 2012/0132043 | A1 * | 5/2012 | Chen et al. | 81/479 |
| 2012/0191378 | A1 * | 7/2012 | Chu et al. | 702/41 |
| 2013/0291694 | A1 * | 11/2013 | Gauthier et al. | 81/479 |

FOREIGN PATENT DOCUMENTS

| | | |
|---|---|---|
| TW | M360114 | 7/2009 |
| TW | I316890 | 11/2009 |
| TW | 201117928 | 6/2011 |

* cited by examiner

*Primary Examiner* — Curtis King
(74) *Attorney, Agent, or Firm* — Guice Patents PLLC

(57) ABSTRACT

A torque warning hand tool includes a main body with one drive head, and a torque detector, a control display device and a warning unit disposed on the main body and electrically connected to each other. The control display device is used to set a preset value and receive a torque value from the torque detector to compare the torque value with the preset value. The warning unit has a first, a second and a third warning modes respectively corresponding to three colored light sources. After compared, according to the warning mode in which the torque value falls, the control display device drives the different colored light sources to emit corresponding colors for an operator to identify the torque extent applied to the hand tool.

10 Claims, 7 Drawing Sheets

TORQUE WARNING HAND TOOL

BACKGROUND OF THE INVENTION

1. Field of the Invention

The present invention relates generally to a hand tool, and more particularly to a torque wrench with warning function.

2. Description of the Related Art

Along with the advance of industries, higher and higher precision of tightening force for threaded members is required. To catch up with the requirement, various wrenches with torque value reminding function have been developed and released to the market.

The applicant's Taiwan Patent No. I316890 discloses a colored warning structure of electronic torque tool. The torque tool has a wrench main body on which a display screen is disposed. In the case that a certain operation value does not reach a preset range, the display module will emit a first colored light to indicate the current value. When the operation value becomes approximate to the preset range, the display module will go a second colored light instead so as to indicate the current value. When the operation value exceeds the preset range, the display module will immediately go a third colored light instead of the second colored light to indicate the current value. It provides a warning and reminding effect, and advantages the electronic tool applicable in any working site without limitation. Moreover, the light with different colors can attract an operator's attention. In addition, the light intensity is sequentially progressively increased to remind the operator to note the change of the operation value.

Taiwan Patent Publication No. 201117928 discloses a colored light warning method for digital torque tool. The digital torque tool has a main body on which an operation unit and a display unit are disposed. According to different percentages of a preset reference torque value, the operation unit can be respectively set with several comparison modes correspondingly connected to the display unit. In Publication No. 201117928, the comparison modes are respectively set as the ranges of below 80%, 80%~100% and over 100% of the preset reference torque value. Therefore, the display unit can emit different colors of light according to the different comparison modes respectively for a user to judge in which value range the current wrenching torque falls so as to facilitate the operation.

In addition, Taiwan Utility Model No. M360114 discloses an integrated numerically controlled tool. The tool is a wrench having a numerically controlled display system and multiple light-emitting diodes (LED) display elements. The LED display elements can sequentially emit light to indicate the current torque value state of the wrench to a user so as to achieve a warning effect.

All the above conventional wrenches will give the warning only when the torque value becomes approximate to the preset value without taking into consideration how close to the preset value the torque value becomes. In general, the conventional wrench has a rough warning range with respect to the preset value. For example, in Taiwan Patent No. I316890, an operator is reminded that the current torque is closer and closer to the preset value. However, as to the requirement for higher precision in torque to meet, the rough warning range provided by the conventional wrench is actually helpless to the operator. For example, in Taiwan Patent Publication No. 201117928, the torque warning start point is too early so that the operator will focus on the torque value too early. Under such circumstance, the perception of the operator to the warning will gradually decline with the time so that the operator will become more and more feeless. In Taiwan Utility Model No. M360114, the torque value state is indicated by the number of the LED display elements to achieve a torque warning effect. Such arrangement can hardly precisely tell when the torque value will reach the preset value. Therefore, an operator cannot precisely stop the operation at a proper time.

It can be known from the above that the conventional techniques have the shortcomings of too early warning point, too large warning range and vague warning effect. As a result, an operator is very likely to misjudge when the desired torque is reached.

It is therefore tried by the applicant to provide a torque warning hand tool, which h has a precise and effective warning range to truly provide a warning effect so as to avoid misjudgment of an operator.

SUMMARY OF THE INVENTION

It is therefore a primary object of the present invention to provide a torque warning hand tool, which has a precise and effective warning range to truly provide a warning effect so as to avoid misjudgment of an operator.

It is a further object of the present invention to provide the above torque warning hand tool, which can provide a display range to offset the delay possibly taking place in the circuit of the electronic hand tool and solve the problem of the conventional wrench that due the operation inertia of an operator, when the operator stops applying the force to the wrench, the torque value will be slightly greater than the desired torque.

It is still a further object of the present invention to provide the above torque warning hand tool, which enables an operator to instantaneously reflectively judge whether the torque value has reached a preset value and quickly operate the wrench within a precise range of torque.

To achieve the above and other objects, the torque warning hand tool of the present invention includes: a main body, a drive head being disposed at at least one end of the main body for tightening a work piece; a torque detector disposed on the main body; a control display device disposed on the main body; and a warning unit disposed on the main body. The torque detector, the control display device and the warning unit are electrically connected to each other. The torque detector serves to detect the bending strain of the main body and output a torque value. The control display device is used to set a preset value and receive the torque value of the torque detector. The control display device includes an operation unit for comparing the torque value with the preset value. The warning unit has a first warning mode, a second warning mode and a third warning mode and three colored light sources with different colors corresponding to the warning modes respectively. The colored light sources serve to emit corresponding colors of light according to different warning modes. After the control display device compares the torque value with the preset value, the control display device drives the corresponding warning mode of the warning unit according to the warning mode range in which the torque value falls, wherein the first, second and third warning modes are respectively defined as the ranges of 96%~99%, 99%~104% and 104%~110% of the preset value.

Still to achieve the above and other objects, the torque warning hand tool of the present invention includes: a main body, a drive head being disposed at at least one end of the main body for tightening a work piece; a torque detector disposed on the main body; a control display device disposed on the main body; and a warning unit disposed on the main body, the torque detector. The control display device and the warning unit are electrically connected to each other. The torque detector serves to detect the bending strain of the main body and output a torque value. The control display device is used to set a preset value and receive the torque value of the torque detector. The control display device includes an operation unit for comparing the torque value with the preset value. The warning unit has a first warning mode, a second warning mode, a third warning mode and a critical mode and three colored light sources with different colors corresponding to the warning modes respectively. The colored light sources serve to emit corresponding colors of light according to different warning modes. The critical mode is not corresponding to any colored light sources so that none of the colored light sources will emit light in the critical mode. After the control display device compares the torque value with the preset value, the control display device drives the corresponding mode of the warning unit according to the mode range in which the torque value falls, wherein the first, second and third warning modes are respectively defined as the ranges of 96%~99%, 99%~104% and 104%~110% of the preset value, while the critical mode falls in the second warning mode.

The present invention can be best understood through the following description and accompanying drawings, wherein:

DETAILED DESCRIPTION OF THE PREFERRED EMBODIMENTS

Figure 1:
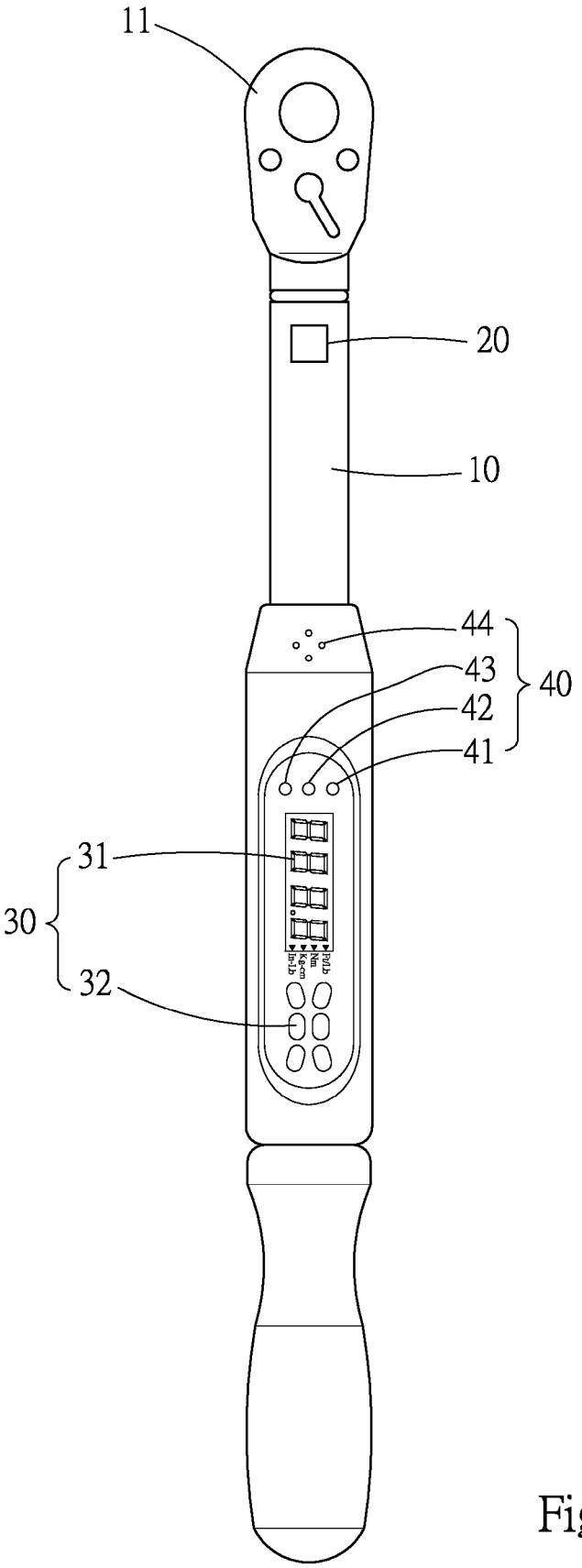
FIG. 1 is a top view of a preferred embodiment of the torque warning hand tool of the present invention.

Please refer to FIG. 1. According to a preferred embodiment, the torque warning hand tool of the present invention is an electronic wrench having a wrench main body 10. A drive head 11 is disposed at one end of the wrench main body 10 for wrenching a work piece. A torque detector 20, a control display device 30 and a warning unit 40 are disposed on the wrench main body 10 and electrically connected with each other.

The torque detector 20 is a strainmeter disposed on the wrench main body in adjacent to the drive head 11 for detecting the bending strain of the hand tool (the wrench main body 10) and outputting a torque value T according to the bending strain.

The control display device 30 is a device for processing signals and displaying data. The control display device 30 can be used to set a preset value τ and receive the torque value T of the torque detector 20. In this embodiment, the control display device 30 includes a display panel 31, a pushbutton module 32 and an operation unit (not shown). An operator can set the preset value τ via the pushbutton module 32 to display the preset value τ on the display panel 31. When the operator operates a work piece by the electronic wrench, the control display device 30 receives the torque value T and the display panel 31 displays the torque value T in actual operation. In addition, the operation unit serves to compare the torque value T with the preset value τ. The control display device 30 is not limited to the display panel 31 and the pushbutton module 32 of this embodiment. Alternatively, the control display device 30 can be a touch panel. In this case, an operator can touch or write on the touch panel to set the preset value τ and input data.

The warning unit 40 at least has a first warning mode 51, a second warning mode 52, a third warning mode 53, and three colored light sources 41, 42, 43 with different colors corresponding to the warning modes 51, 52, 53 respectively. The colored light sources 41, 42, 43 serve to emit different colors of light according to different warning modes. The circuit of the electronic wrench is adapted to the display module or different materials of LED/OLED (organic light-emitting diode) or the design of the strainmeter. As a result, delay may take place in the circuit to affect the precision of the displayed torque value. Moreover, the most likely cause of torque error is the operation inertia of the operator. Due the operation inertia, when the operator stops applying the force to the wrench, the torque value will be slightly greater than the desired torque. The warning modes 51, 52, 53 are three independent ranges proximate to the preset value τ in different proportions. In this case, the error can be offset and the effective warning range can be achieved. Therefore, the shortcoming of the conventional technique that the torque warning start point is too early to make the operator misjudge when the desired torque is reached can be overcome.

In this embodiment, the first, second and third warning modes 51, 52, 53 are defined respectively according to the ranges of 96%~99%, 99%~104% and 104%~110% of the preset value τ. When an operator operates the wrench and gradually applies a force thereto, the torque detector 20 outputs the torque value T. The operation unit of the control display device 30 receives the torque value T and compare the torque value T with the preset value τ to achieve a ratio. According to the ratio, the warning unit 40 judges in which warning mode range the ratio falls so as to drive different warning modes to make the corresponding colored light sources emit light. The colored light sources 41, 42, 43 are yellow, green and red respectively. In the respective warning modes of the warning unit 40, only the colored light sources corresponding to the warning modes are driven.

In this embodiment, the colored light sources 41, 42, 43 are three LED or OLED lights independently disposed outside the control display device 30. The colored light sources 41, 42, 43 are arranged on the main body 10 and electrically connected to the control display device 30. The colored light sources 41, 42, 43 and the control display device 30 can be modularized and mounted on the main body 10 together with the control display device 30. The colored light sources 41, 42, 43 of the present invention can emit different colors of light under different torque extents, whereby an operator can identify the torque applied to the hand tool from the color. Therefore, the colored light sources independently disposed outside the control display device 30 are not limited to this embodiment. Alternatively, the colored light sources can be replaced with LED light strips arranged on the main body 10 or the control display device 30 in a surrounding form, radial form or parallel form to enlarge the light emission range and enhance the warning effect. Moreover, the colored light sources 41, 42, 43 can be inbuilt in the control display device 30 to emit light from the display panel 31 of the control display device 30 and achieve a color-changing effect for the display panel 31. In this case, the operator can be alerted when the color of the display panel 31 changes.

The warning unit 40 further has a sound-emitting element. In this embodiment, the sound-emitting element is a buzzer 44. The different sound intensities and/or intermittence frequencies of the sound-emitting element correspond to the warning modes of the warning unit 40 respectively. That is, the buzzing states of the sound-emitting element in different warning modes are classified according to the sound intensities and/or intermittence frequencies of the sound-emitting element respectively or both at the same time. According to the ratio of the torque value T to the preset value τ, the warning unit 40 judges in which warning mode range the ratio falls to drive the buzzer 44 to buzz indifferent states. For example, the sound intensity can gradually increase and/or the intermittence frequency can gradually increase. These two states can exist in different warning modes respectively or exist in the same warning mode. For example, the sound intensity of the buzzer 44 in the second warning mode 52 is stronger than the sound intensity in the first warning mode 51. Alternatively, the intermittence frequency of the buzzer 44 in the second warning mode 52 is faster than the intermittence frequency in the first warning mode 51. The changes of the sound intensity and the intermittence frequency can exist respectively or both at the same time.

Figure 2:
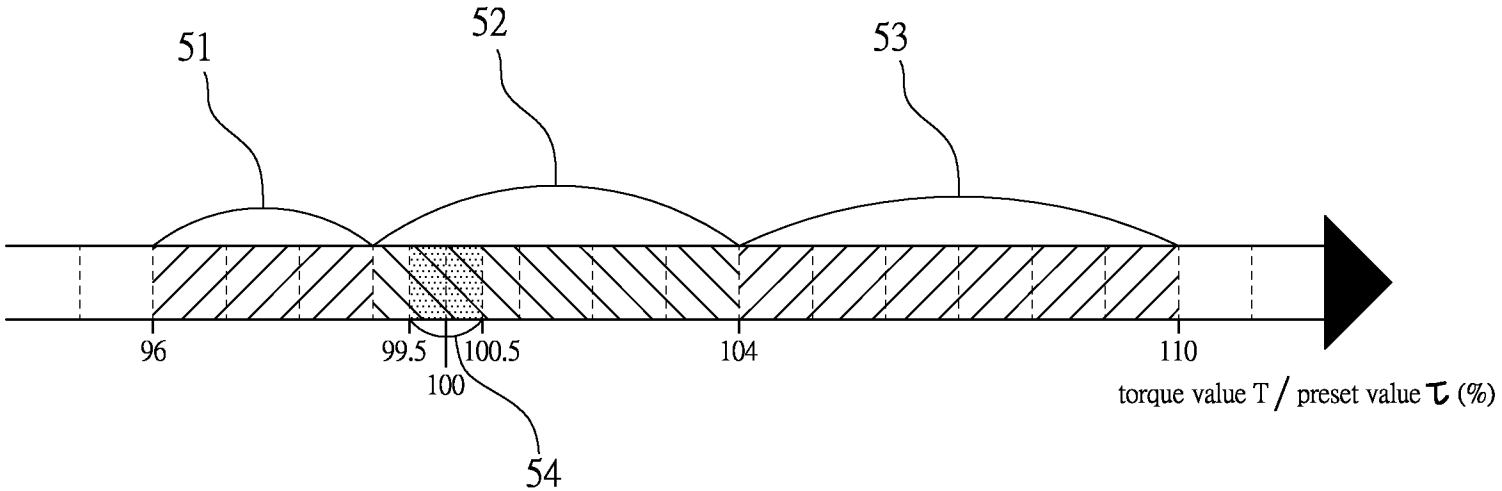
FIG. 2 is a diagram showing the torque progress of the torque warning hand tool of the present invention.

Please refer to FIG. 2, which is a diagram showing the torque progress of the torque warning hand tool of the present invention. When an operator operates the torque warning hand tool of the present invention and gradually applies a force thereto, the ratio of the torque value T to the preset value τ will gradually increase and become closer and closer to the set warning modes of the warning unit 40. As aforesaid, the first, second and third warning modes 51, 52, 53 of the warning unit 40 are defined respectively according to the ranges of 96%~99%, 99%~104% and 104%~110% of the preset value τ. Therefore, the colored light sources of the respective warning modes can continuously emit light or flicker with the flickering frequency progressively increasing or the flickering frequency of the current stage faster than the flickering frequency of the last stage. The sound intensity of the buzzer 44 can gradually increase or the buzzer 44 can continuously buzz or the intermittence frequency of the buzzer 44 can gradually increase or the changes of the sound intensity and the intermittence frequency can be combined.

Figure 3:
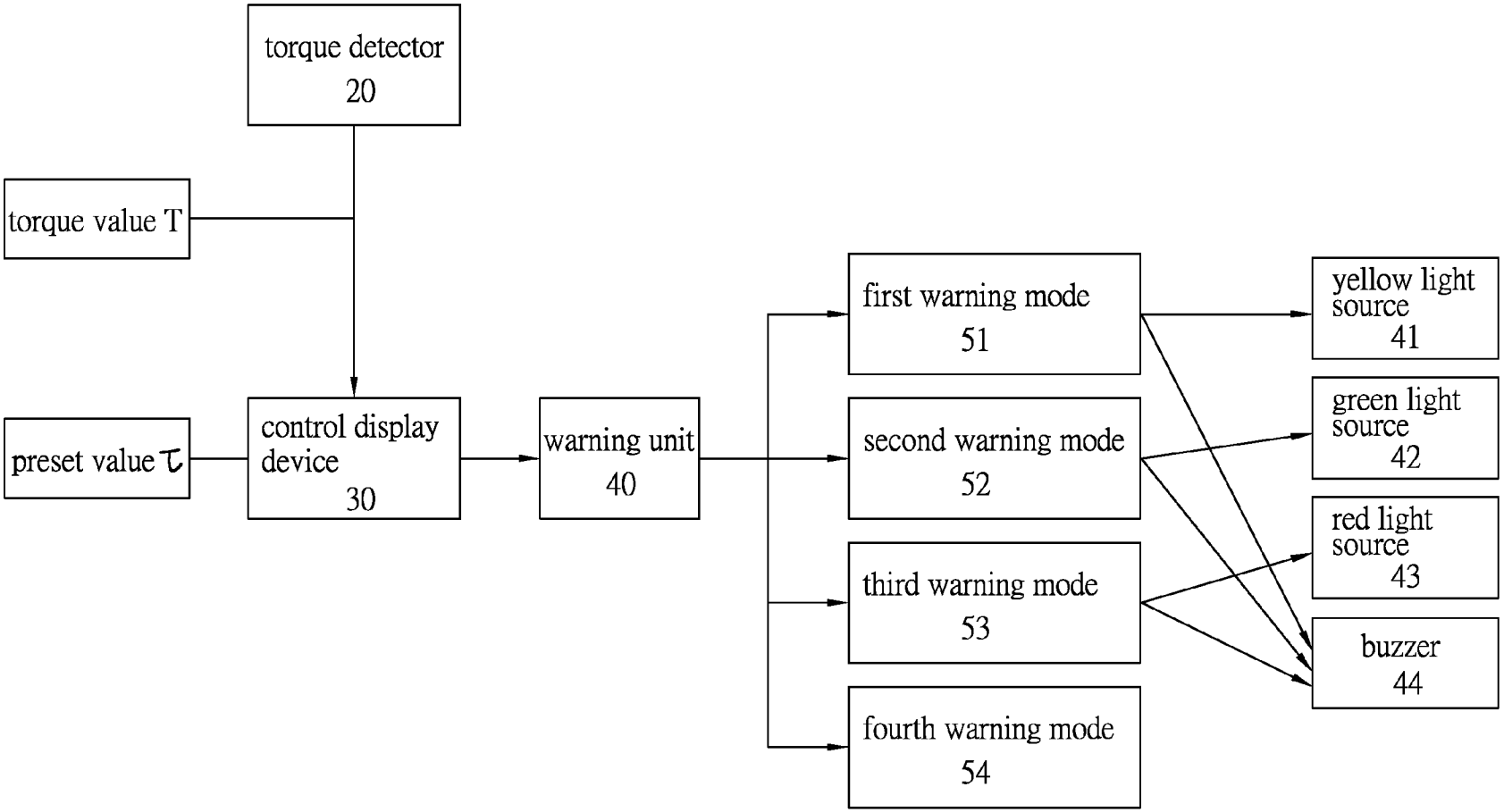
FIG. 3 is a block diagram of the torque warning hand tool of the present invention.
Figure 4A:
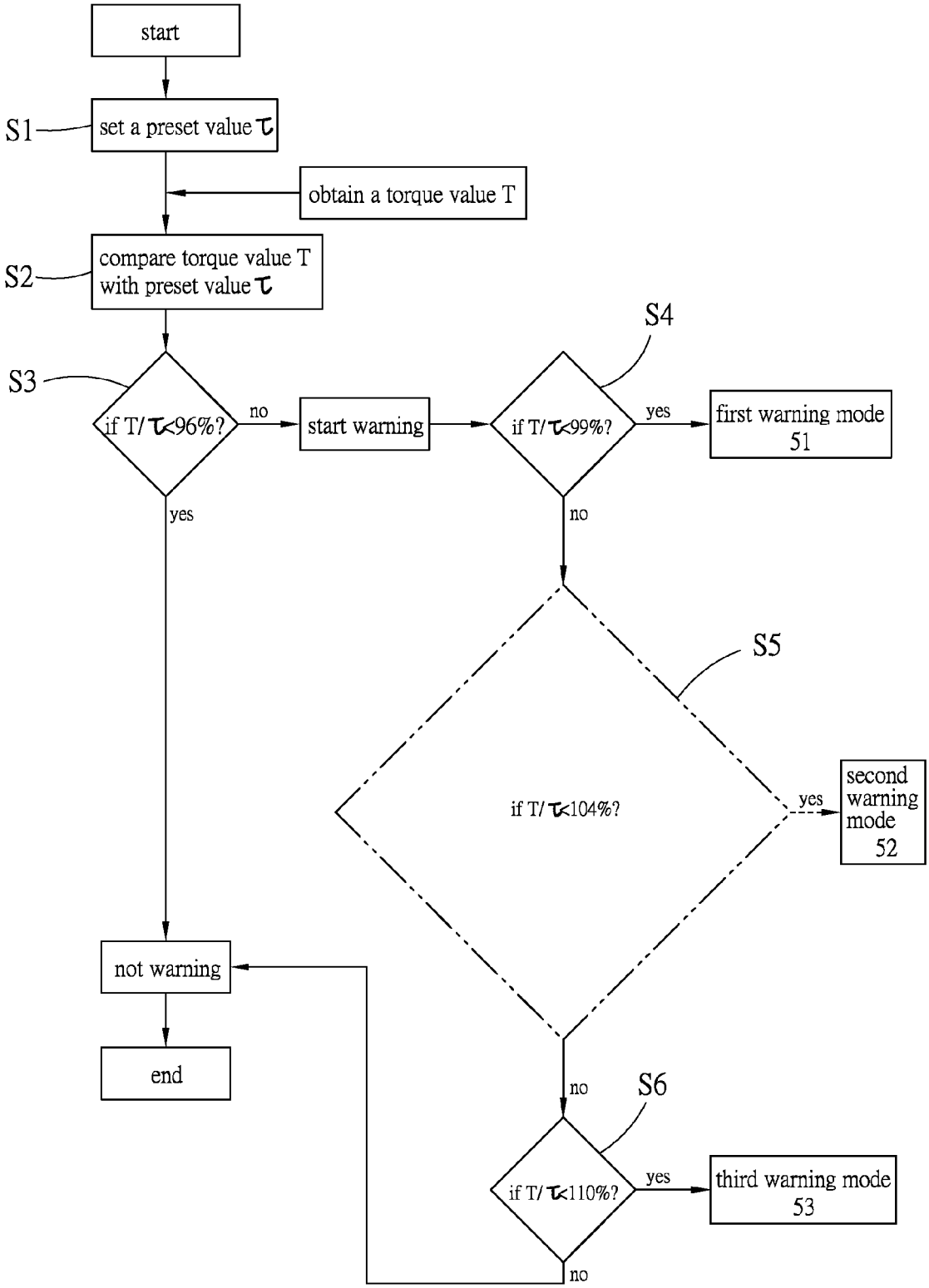
FIG. 4A is a flowchart of the preferred embodiment of the torque warning hand tool of the present invention.
Figure 5A:
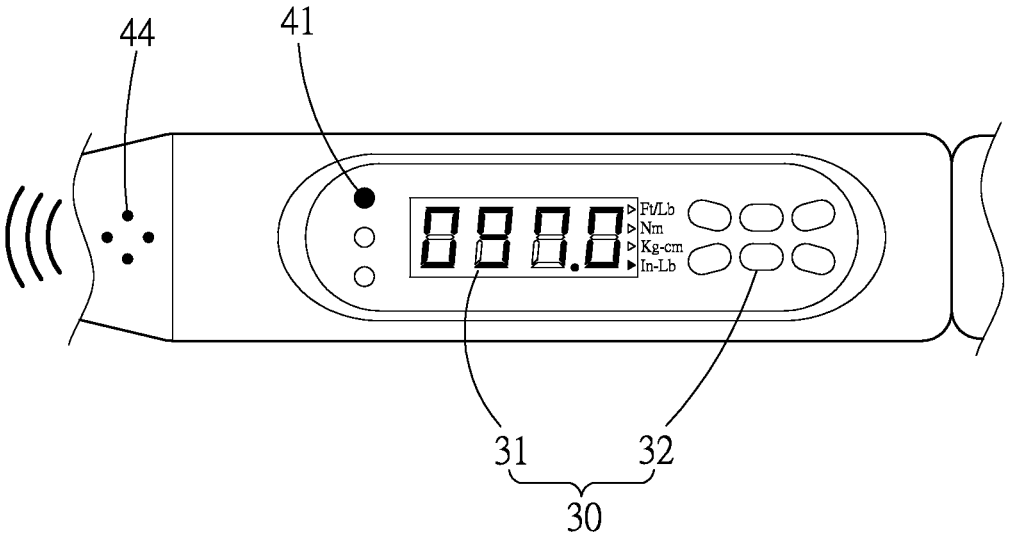
FIGS. 5A to 5D are top views of the torque warning hand tool of the present invention in different warning modes under different torque values respectively.
Figure 5B:
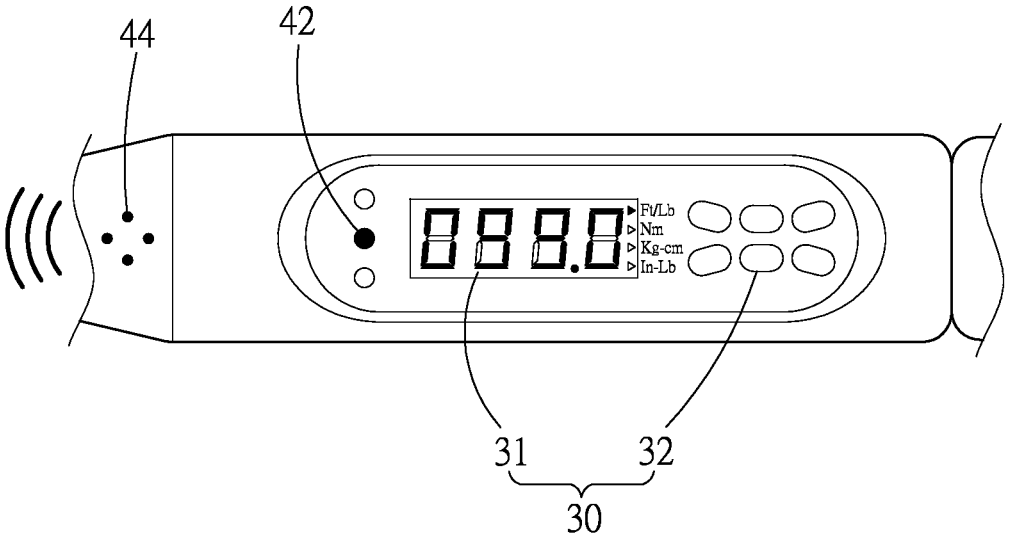
Figure 5C:
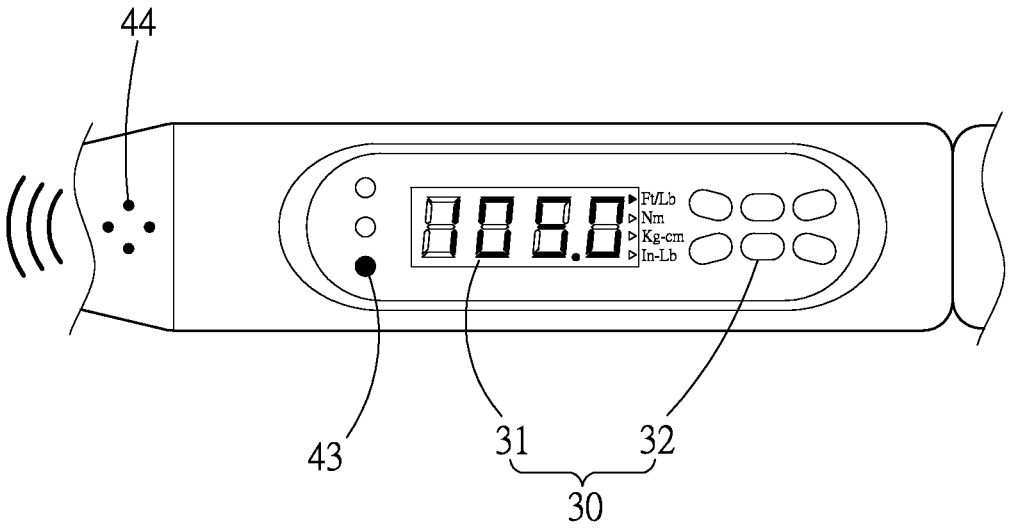

Please now refer to FIGS. 3 and 4A. FIG. 3 is a block diagram of a preferred embodiment of the torque warning hand tool of the present invention. FIG. 4A is a flow chart of the preferred embodiment of the torque warning hand tool of the present invention. As referring to FIGS. 5A to 5C, the warning procedure of the torque warning hand tool of the present invention is described as follows:

step S1: Before wrenching the work piece, the control display device 30 of the torque warning hand tool of the present invention is set with a preset value τ of 100 Ft-lb.

step S2: Along with the gradually increased force applied to the wrench by the operator, the control display device 30 obtains a gradually increased torque value T from the torque detector 20 and continuously compares the torque value T with the preset value τ.

step S3: In the case that the ratio of the torque value T to the preset value τ is smaller than 96%, the warning unit 40 is out of warning to be a not warning state. Once the ratio of the torque value T to the preset value τ becomes equal to 96%, the warning unit 40 is driven into the warning state.

step S4: The control display device 30 compares the torque value T with the preset value τ to see whether the ratio of the torque value T to the preset value τ is smaller than 99%. In the case that the ratio of the torque value T to the preset value τ is smaller than 99%, the warning unit 40 is in the first warning mode 51. Once the ratio of the torque value T to the preset value τ becomes equal to 99%, the procedure goes to step S5. As shown in FIG. 5A, when the torque value T increases to 97 Ft-lb, the ratio falls in the range (96%~99% of the preset value τ) of the first warning mode 51. At this time, the yellow light source 41 of the warning unit 40 flickers with the flickering frequency progressively increased and the buzzer 44 intermittently buzzes to remind the operator that the torque value is proximate to the preset value τ of 100 Ft-lb.

step S5: The control display device 30 compares the torque value T with the preset value τ to see whether the ratio of the torque value T to the preset value τ is smaller than 104%. In the case that the ratio of the torque value T to the preset value τ is smaller than 104%, the warning unit 40 is in the second warning mode 52. Once the ratio of the torque value T to the preset value τ becomes equal to 104%, the procedure goes to step S6. As shown in FIG. 5B, when the torque value T reaches 99 Ft-lb, the ratio falls in the range (99%~104% of the preset value τ) of the second warning mode 52. At this time, the warning unit 40 is switched from the yellow light source 41 to the green light source 42. At this time, the yellow light source 41 is turned off, while the green light source 42 flickers with the flickering frequency progressively increased and the buzzer 44 intermittently buzzes at a frequency higher than that of the last stage with the sound intensity also increased. At this stage, the operator is reminded that the torque value T is to reach the preset value τ of 100 Ft-lb and the operator should be ready to stop wrenching the work piece.

step S6: The control display device 30 compares the torque value T with the preset value τ to see whether the ratio of the torque value T to the preset value τ is smaller than 110%. In the case that the ratio of the torque value T to the preset value τ is smaller than 110%, the warning unit 40 is in the third warning mode 53. When the ratio of the torque value T to the preset value τ is larger than or equal to 110%, the warning unit 40 is restored to the not warning state, which is out of warning. As shown in FIG. 5C, in the case that the torque value is 105 Ft-lb, the ratio falls in the range (104%~110% of the preset value τ) of the third warning mode 53. At this time, the torque actually applied to the work piece has far exceeded the necessary preset value τ. The over torque will lead to residual stress between the working piece and a tightened article to affect the threading effect or even damage the work piece or the tightened article. At this stage, a stronger warning effect is needed. Accordingly, the warning unit 40 is switched from the green light source 42 to the red light source 43. At this time, the green light source 42 is turned off, while the red light source 43 continuously emits light rather than flickers and the buzzer 44 continuously buzzes rather than intermittently buzzes with the sound intensity increased. Between the two warning modes 52, 53, the green and red lights are switched in contrast so as to clearly remind the operator that a risky stage has started.

Figure 4B:
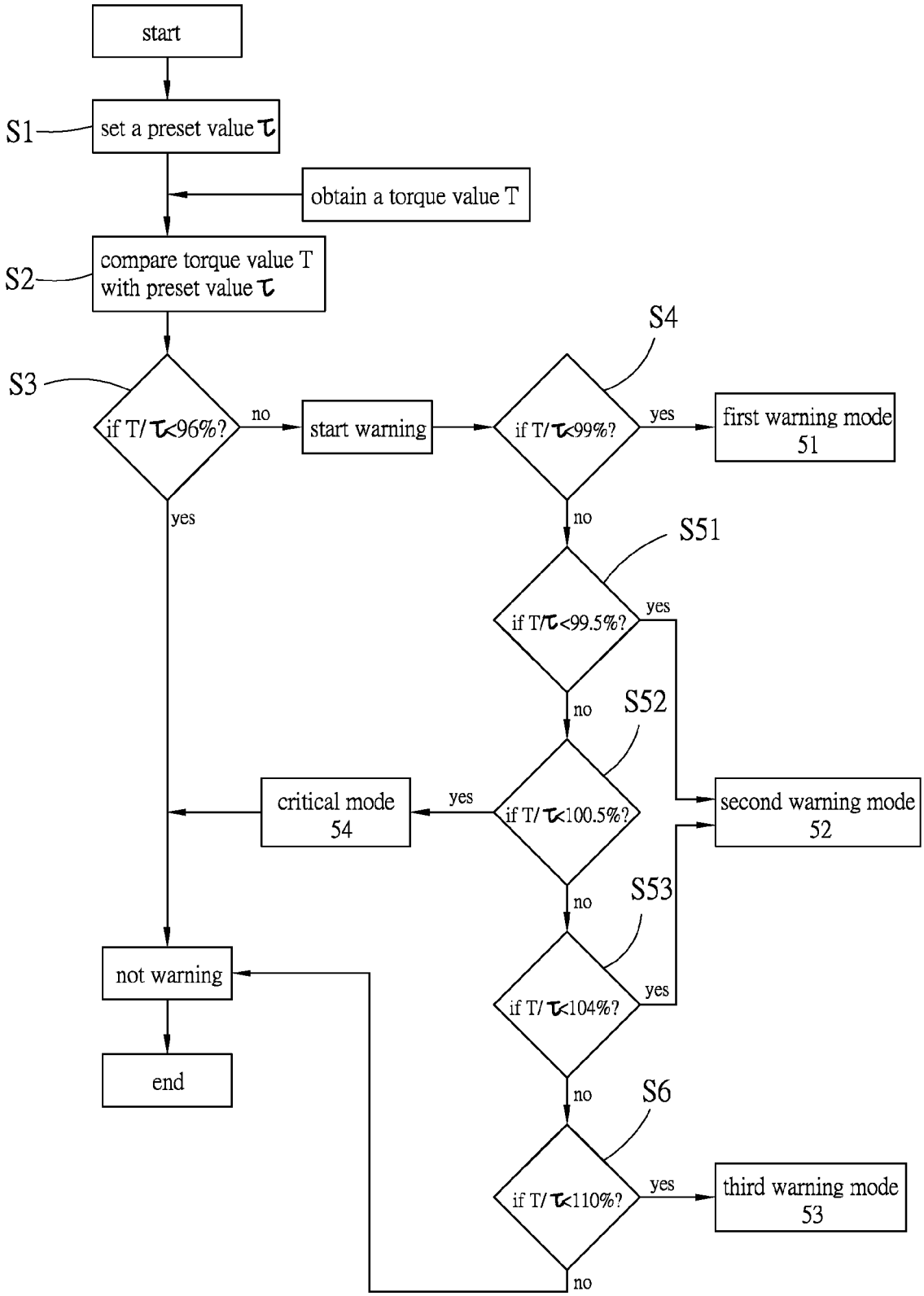
FIG. 4B is a flow chart of another preferred embodiment of the torque warning hand tool of the present invention.

In another embodiment of the torque warning hand tool of the present invention, the warning unit 40 further has a critical mode 54 over the preset value τ. The critical mode 54 does not correspond to any of the colored light sources 41, 42, 43 or the sound-emitting element as shown in FIG. 3. As referring to FIGS. 2 and 4B, the critical mode 54 falls in the second warning mode 52. The critical mode 54 is defined with a range of 99.5%~100.5% of the preset value τ. In the case that after compared, the ratio of the torque value T to the preset value τ falls in the critical mode 54, none of the colored light sources 41, 42, 43 of the warning unit 40 will emit light and the buzzer 44 is silenced. At this stage, the operator is reminded that the torque value T is about to become over the preset value τ of 100 Ft-lb and the operator should immediately stop wrenching the work piece.

Figure 5D:
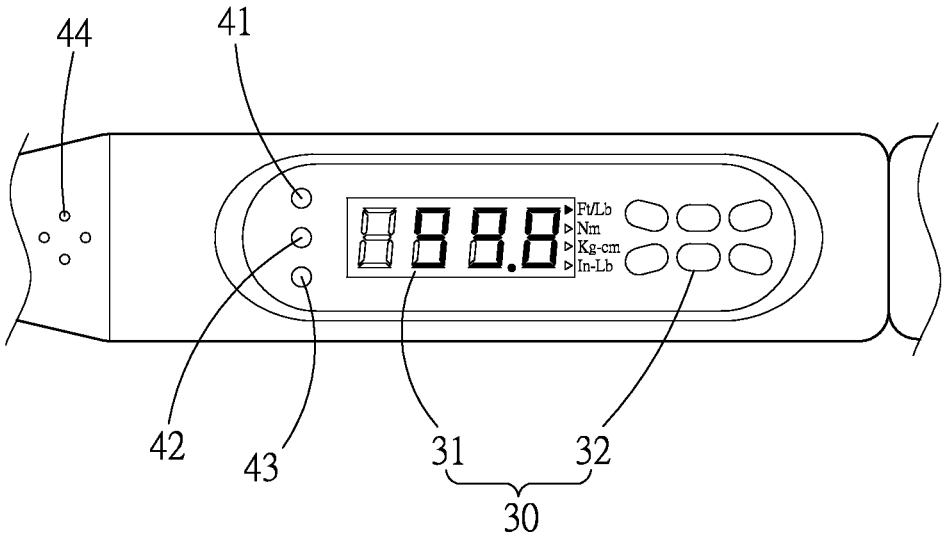

The steps from the previous embodiment are described in short as follows:

In step S4 of the warning procedure, once the ratio of the torque value T to the preset value τ becomes equal to 99%, the procedure goes to step S51.

step S51: The control display device 30 compares the torque value T with the preset value τ to see whether the ratio of the torque value T to the preset value τ is smaller than 99.5%. In the case that the ratio of the torque value T to the preset value τ is smaller than 99.5%, the warning unit 40 goes into the second warning mode 52. Once the ratio of the torque value T to the preset value τ is equal to 99.5%, the procedure goes to step S52.

step S52: The control display device 30 compares the torque value T with the preset value τ to see whether the ratio of the torque value T to the preset value τ is smaller than 100.5%. In the case that the ratio of the torque value T to the preset value τ is smaller than 100.5%, the warning unit 40 goes into the critical mode 54. As shown in FIG. 5D, when the torque value reaches 99.8 Ft-lb, the ratio falls in the range (99.5%~100.5% of the preset value τ) of the critical mode 54. At this time, the warning unit 40 will not emit light or buzz. The original green light source 42 of the second warning mode 52 is turned off and the buzzer 44 stops buzzing. The warning unit 40 does not emit light or buzz to provide double warning effects for the operator via a pseudo abnormality so as to remind the operator that the operation should be immediately stopped. Once the ratio of the torque value T to the preset value τ is equal to 100.5%, the procedure goes to step S53.

step S53: The control display device 30 compares the torque value T with the preset value τ to see whether the ratio of the torque value T to the preset value τ is smaller than 104%. In the case that the ratio of the torque value T to the preset value τ is smaller than 104%, the warning unit 40 is restored to the second warning mode 52. Once the ratio of the torque value T to the preset value τ becomes equal to 104%, the procedure goes to step S6. Step S6 is as the aforesaid and thus will not be repeatedly described hereinafter.

In this embodiment, the pseudo abnormality is defined in the second warning mode 52 to provide warning effect in another manner. When going into the second warning mode 52, the operator has already focused on the displayed torque value T and is mentally ready to reach the preset value τ at any time. Therefore, once the operator finds that the hand tool neither emits any light nor buzzes, the operator is reversely reminded to make the operator instantaneously judge whether the torque value has reached the preset value τ and instinctively stop the operation. This is an instantaneous reflective operation mode for enabling an operator to quickly and precisely operate the wrench.

According to the above arrangement, the torque warning hand tool of the present invention is able to provide a warning effect to offset the delay possibly taking place in the circuit of the electronic wrench and solve the problem of the conventional wrench that due the operation inertia of an operator, when the operator stops applying the force to the wrench, the torque value will be slightly greater than the desired torque. Moreover, the torque warning hand tool of the present invention can overcome the shortcoming of the conventional technique that the torque warning start point is too early. Therefore, the operator will not misjudge when the desired torque is reached. Accordingly, the torque warning hand tool of the present invention truly can provide a warning effect. In addition, the warning ranges of the torque warning hand tool of the present invention are properly selected so that an operator can instantaneously judge whether the torque value has reached the preset value τ and instinctively reflectively stop the operation. Therefore, the operator can quickly operate the wrench within a precise range of torque.

The above embodiments are only used to illustrate the present invention, not intended to limit the scope thereof. Many modifications of the above embodiments can be made without departing from the spirit of the present invention.

What is claimed is:

1. A torque warning hand tool comprising:

a main body, a drive head being disposed at least one end of the main body for tightening a work piece;

a torque detector disposed on the main body;

a control display device disposed on the main body; and a warning unit disposed on the main body;

the torque detector, the control display device and the warning unit being electrically connected to each other;

the torque detector serving to detect the bending strain of the main body and output a torque value;

the control display device being used to set a preset value and receive the torque value of the torque detector, the control display device including an operation unit for comparing the torque value with the preset value, the warning unit having three warning modes including a first warning mode, a second warning mode, a third warning mode, and three colored light sources with different colors corresponding to the warning modes respectively, the colored light sources serving to emit corresponding colors of light according to different warning modes, after the control display device compares the torque value with the preset value, the control display device driving the corresponding mode of the warning unit according to the mode range in which the torque value falls; wherein the warning unit provides three warnings corresponding to the three warning modes when the torque value being in the range of 96%-110% of the preset value, the first warning mode, the second warning mode, and the third warning mode are respectively defined as the torque value being in a range of 96%-99%, 99%-104% and 104%-110% of the preset value, and the warning unit further having a critical mode, the critical mode falls in the second warning mode, the critical mode not corresponding to any colored light sources, wherein, when the torque value falls in the critical mode, none of the colored light sources will emit light in the critical mode.

2. The torque warning hand tool as claimed in claim 1, wherein the critical mode is defined as the torque value being in a range of 99.5% to 100.5% of the preset value, the warning unit providing no warning when the torque value is in the range of 99.5% to 100.5% of the preset value.

3. The torque warning hand tool as claimed in claim 1, wherein the colored light sources corresponding to the respective warning modes of the warning unit flicker to emit light.

4. The torque warning hand tool as claimed in claim 3, wherein the flickering frequencies of the colored light sources corresponding to the respective warning modes of the warning unit are progressively increased.

5. The torque warning hand tool as claimed in claim 1, wherein the colored light sources corresponding to the three warning modes of the warning unit continuously emit light.

6. The torque warning hand tool as claimed in claim 1, wherein the warning unit further has a sound-emitting element, the sound-emitting element having different sound intensities and/or intermittence frequencies corresponding to the warning modes of the warning unit respectively.

7. The torque warning hand tool as claimed in claim 6, wherein in the same warning mode and/or different warning modes, the sound intensity of the sound-emitting element is progressively increased and/or the intermittence frequency of the sound-emitting element is progressively increased.

8. The torque warning hand tool as claimed in claim 7, wherein in the third warning mode of the warning unit, the sound-emitting element continuously emits sound.

9. The torque warning hand tool as claimed in claim 1, wherein the warning unit further has a sound-emitting element, the sound-emitting element having different sound intensities and/or intermittence frequencies corresponding to the warning modes of the warning unit respectively, the critical mode being not corresponding to the sound-emitting element so that the sound-emitting element will not emit sound in the critical mode.

10. The torque warning hand tool as claimed in claim 2, wherein the warning unit further has a sound-emitting element, the sound-emitting element having different sound intensities and/or intermittence frequencies corresponding to the respectively, the critical mode being not corresponding to the sound-emitting element so that the sound-emitting element will not emit sound in the critical mode.

* * * * *